United States Patent [19]

Kitayama et al.

[11] 3,950,575

[45] Apr. 13, 1976

[54] HEAT TREATMENT OF METALS IN A CONTROLLED SURFACE ATMOSPHERE

[75] Inventors: Minoru Kitayama; Susumu Yamaguchi; Hisao Odashima, all of Himeji, Japan

[73] Assignee: Nippon Steel Corporation, Tokyo, Japan

[22] Filed: Jan. 18, 1974

[21] Appl. No.: 434,447

[30] Foreign Application Priority Data

Jan. 23, 1973 Japan ..... 48-489206

[52] U.S. Cl. ..... 427/226; 427/372; 427/383; 427/403; 427/404; 427/405; 427/419

[51] Int. Cl.[2] ..... C23C 3/00

[58] Field of Search.... 117/21 M, 69, 169 A, 135.1, 117/127; 148/6; 106/38.3, 74; 427/229, 252, 283, 405, 419, 253

[56] References Cited

UNITED STATES PATENTS 3,698,943 10/1972 Colantuono ..... 117/53

FOREIGN PATENTS OR APPLICATIONS 251,144 5/1966 U.S.S.R. ..... 106/38.3

*Primary Examiner*—Cameron K. Weiffenbach
*Assistant Examiner*—Ralph E. Varndell, Jr.
*Attorney, Agent, or Firm*—Toren, McGeady and Stanger

[57] ABSTRACT

A process of treating metals with coatings capable, upon heating, of providing and maintaining a controlled atmosphere around the surfaces of said metals which process comprises coating the surfaces of said metals with base coating composition capable, upon heating, of providing a gas, and then with an overcoating composition capable of maintaining the gas around the surfaces of the metals at high temperatures while excluding an environmental oxidizing atmosphere therefrom, and thereafter heating the coated metals in the oxidizing atmosphere.

5 Claims, 30 Drawing Figures

No Cr Diffusion Layer (Comparative)

No Cr Diffusion Layer (Comparative)

Cr Diffusion Layer

HEAT TREATMENT OF METALS IN A CONTROLLED SURFACE ATMOSPHERE

BACKGROUND OF THE INVENTION

1. Field of the Invention

This invention relates to a process of treating metals with a coating which is adapted for heat treatment in an uncontrolled oxidizing atmosphere without causing oxidation, decarburization and other objectionable results on the surface of the treated metals. More particularly, it relates to a process of treating metals which comprises applying to said metals, a double layer coating of which the base coating layer is contiguous with the metal surface and is capable, upon heating, of evolving a certain gas, and the over-coating layer which is applied on said base coating layer is capable, upon heating, of excluding the uncontrolled oxidizing atmosphere from the surface of the base coating layer to provide and to maintain a controlled surface atmosphere containing the gas next to the metal surface during a time interval sufficient to carry out the subsequent desired heat treatment at higher temperatures than was possible before. The process is particularly adapted for prevention of the surface decarburization of the metal which is subjected to heat treatment in an oxidizing atmosphere as well as for applications requiring the carburizing and nitriding of metal and the processes in which Zn, Al, Cr, Si, Mo, W, B, Ti, Pb, Ni, Cu, Fe, Mg, Mn, Co, Ge, Ac, Se, Zr and Sn are penetrated into base metals by diffusion.

2. Description of the Prior Art

In general, steel products, such as, steel sheets and strips, are manufactured by subjecting semi-finished steels in forms, such as, slabs, beam blanks, and billets to a heat treatment followed by rolling treatments, the heating conditions in the furnace depending upon the composition and thickness of the semi-finished steels and usually being from 1150°–1350°C for several hours. By such a heat treatment, a large amount of scale is formed on the surface of the treated steel, and, moreover, a loss of carbon from the steel surface results from the reaction of the carbon with oxygen in the oxidizing atmosphere to form CO and $CO_2$, so that the resultant steel sheet and strip have a decarburized layer on the surface thereof. Although the decarburized layer is beneficial to the welding of the steel product to some extent, it is unfavorable for the production of silicon steel sheets with improved magnetic properties. Particularly in the heat treatment of silicon steel, therefore, it is very important to prevent the surface decarburization.

Various anti-decarburizing agents have been developed, some of which have found wide acceptance. Further, it is already known to apply an antioxidant coat on the surface of metal to be treated. However, neither the anti-decarburizing agent coat nor the antioxidant coat provide sufficient effects. The antioxidant coat is almost ineffective for the prevention of decarburization particularly when it is applied on silicon steel which usually has a large amount of scale adhering thereto, because the oxygen in the scale serves to decrease the carbon content at the surface.

Many processes by which the surface of a metal is impregnated with another metal by diffusion have been investigated and developed by many investigators, and some of these processes have found practical uses. Many of the practical processes are adapted for employment of steel as the base metal, and the steel is heated in contact with an element-bearing material to 800°–1000°C for a period of more than 10 hours in a reducing or inert gas atmosphere to cause penetration of the element into the base steel to depths up to several microns with a corresponding lowered element content. To impact increased corrosion resistance to steel, zinc and chromium are usually used as the diffusing element, the processes therefor being referred to as "sheradizing" and "chromizing" respectively. To impart increased heat resistance to steel, aluminum is used, the process therefor being referred to as "calorizing". Other elements such as Si, Mo, W, B and Ti may be used to impart improved properties to steel. To impart increased surface hardness to steel, the carburizing and nitriding treatments are employed. In the former connection, steel is heated to 800°–1000°C in an atmosphere of carbon monoxide, methane, ethane or propane, whereby these gases decomposed on the steel surface to provide carbon which serves to carburize the steel. In the latter connection, an iron-base alloy of special composition containing Al, Cr, V, Mn and/or Si is heated to 500°–600°C in an atmosphere of ammonia, to produce nitrogen by the dissociation of ammonia and which penetrates into the alloy to react therein with the alloying elements. The thus formed nitride provides the hardness.

All of these processes of modifying the surface of steel by diffusion require reducing or neutral atmospheres. As the reducing atmosphere, use may be made of hydrogen or a mixture of hydrogen and hydrogen halide, such as, HCl. Also ammonium halide and halogen are sometimes usuable. When a powdered diffusing element is heated in contact with an additive, for example $NH_4Cl$, and an anti-sintering agent in a prepared atmosphere, penetration of the element is caused at the surface of the steel on the basis of the following reaction path.

$$NH_4Cl \rightarrow NH_3 + HCl\ (gas)$$

$$HCl\ (gas) + Me\ (powder) \rightarrow MeCl_2(gas) + H_2$$

$$MeCl_2 + Fe\ (base\ metal) \rightarrow FeCl_2 + Me^*$$

$$MeCl_2 + H_2 \rightarrow 2HCl + Me^*$$

(wherein Me* represents a diffusing element atom in the nascent state).

However, the prior art process and apparatus therefor have several disadvantages, one of which is that the preparation of a controlled reducing or neutral atmosphere is very costly.

Another disadvantages is that the heat source of the furnace in which the slab or billet is subjected to a heat treatment at 1150°–1350°C for several hours is the combustion of fuel, such as, blast furnace gas, coke oven gas, heavy oil and mixtures thereof, and, therefore, an oxidizing atmosphere is usually produced by burning the fuel with an excess of oxygen over that needed for complete combustion of the fuel. Therefore, the heating of steel with or without a diffusion coating in such an oxidizing atmosphere causes oxidation of the coating and steel surface resulting in the formation of scale in large amounts. Attempts have been made to reduce the amount of scale by utilizing induction heating in a protective atmosphere, but the preparation of the protective atmosphere in such large volumes i.e., to fill the inside of the furnace is very expensive. using Another disadvantage is that the siliconized steels produced by the powder pack method using silicon powder, ferrosilicon powder or silicon carbide powder and by the vapor phase method using silicon tetrachloride are porous at the surface because of the rapid penetration of silicon atoms into the base steel. Such a porous surface is characterized by a lack of sufficient resistance to corrosion, so that conventional siliconized steels is seldom used as corrosion-resistant steel, but rather as an abrasion-resistant steel in view of the increased surface hardness. Attempts have been made to form a non-porous silicon-diffused layer by suing the vapor phase method with a modification such that steels containing carbon in relatively large amounts, or carburized steels are used as the base steel. In these cases, however, the heat treatment should be carried out at a temperature higher than 1100°C at which the austenitic grains in the base steel grow considerably, so that the resultant siliconized steel has inferior mechanical properties.

The stress corrosion cracking of which the mechanism of formation in steel is uncertain although various theories have so far been set up may be considered to be one type of the retarded rupture which is encountered when tension steels and stainless steels are subjected to tensile stress under special conditions. On the basis that the cracking is usually caused from the surface, attempts have been made to impart increased surface softness to such steels by utilizing surface decarburization or surface reheating treatment. However, the surface softening caused by these heat treatments is based on a decrease of the content of the alloying element effective to cause the softening, or on a modification of the crystalline structure of the steel, so that only modest increases in resistance to stress-corrosion cracking can be effected. Usually the increase is by a factor of 1.3 to 1.8.

Considering the facts that the surface softening is effective to increase the resistance to stress-corrosion cracking, and that pure metals have high resistances to the stress-corrosion cracking, the present inventors have made attempts to form a diffused layer containing more than 99% of iron at the surface of the steel having a high susceptability to the stress-corrosion cracking.

SUMMARY OF THE INVENTION

A first object of the present invention is to provide a process of treating steels with coatings adapted to withstand heat treatments without effecting decarburization. The process is characterized by including the steps of applying a base coating and an over-coating prior to the step of heat treatment, the base coating being capable, upon heating, of evolving CO or $CO_2$, and the over-coating containing an antioxidant agent and being capable of maintaining the produced CO and $CO_2$ around the steel surface. This double layer coating very effectively prevents decarburization from occuring at the surface of the steel during the heat treatment.

A second object of the present invention is to provide a process by which an element is caused to diffuse into a base metal which process may be carried out in atmospheric air and which process includes the steps of applying a diffusion coating and applying over it an over-coating, the double layer coating being capable, upon heating, of providing and maintaining on the surface of the base metal, a desired controlled atmosphere independent of the environmental atmosphere, so that the diffusing process operation can be easily carried out at very low cost.

A third object of the present invention is to provide siliconized steels of small crystal grain and having a non-porous silicon-diffused layer, i.e. having greatly enhanced corrosion resistance and good mechanical properties. It is to be noted that in order to accomplish this object, the application of hot working treatments subsequent to the heat treatment is essential.

A fourth object of the present invention is to provide an economic process for producing siliconized steels having the above-mentioned characteristics without the necessity of carrying out complicated procedures. This object is accomplished by making it possible to carry out the siliconizing process in an ambient atmosphere as in the conventionally used furnace for hot rolling operations.

A fifth object of the present invention is to provide for the production of retarded rupture resistant steel sheet and strip having at the surface an iron-enriched layer having a thickness of more than 10 microns and containing more than 99% of iron from semi-finished steels having high susceptibilities to the retarded rupture.

These and other objects of the invention will become more apparent when read in reference with the following description in which:

DESCRIPTION OF THE PREFERRED EMBODIMENTS

In order to accomplish the first object of the present invention, a steel part to be treated is coated with a thin film of a material capable, upon heating, of producing CO and/or $CO_2$, said material being organic compounds or a composition containing one or more compounds selected from carbon, carbides and carbonates of Li, Be, Na, Mg, Al, Si, K, Ca, Se, Mn, Fe, Co, Ni, Cu, Zn, Ga, Se, Rb, Sr, Ag, Cd, Ba, Cs and Pb dispersed in a binder, such as, water glass. Applied over the thin film coating, or the base coating, is an over-coating capable of maintaining the produced CO and $CO_2$ around the surface of the steel part during heat treatment. As the over-coating material, use may be made of any of the commercially available antioxidants which have sufficient antioxidizing effects at high temperatures. When the thus coated steel part is heated in a furnace, the base coating contiguous to the steel surface undergoes a thermal decomposition to produce carbon dioxide in the case of carbonate, or carbon in the case of carbide or organic compound, and the carbon is then combined with trace amounts of oxygen diffusing through the over-coating, so that the space between the steel surface and the over-coating is saturated with these gases which serve to prevent the decarburization of the steel during heat treatment.

Another advantage of the double layer coating of the above compositions is that steel parts having scale on the surface may be employed for application of the coatings which permits a heat treatment to be carried out without causing decarburization due to oxygen present in the scale.

Figure 1:
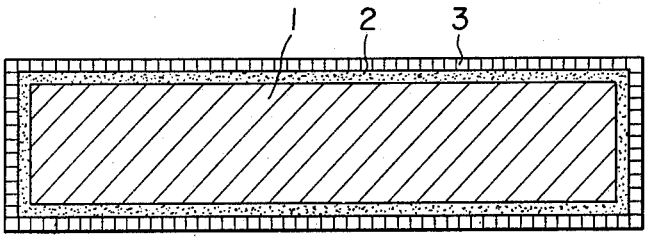
FIG. 1 is a sectional view of a double layer coating applied on a steel part in accordance with the invention.
Figure 2:
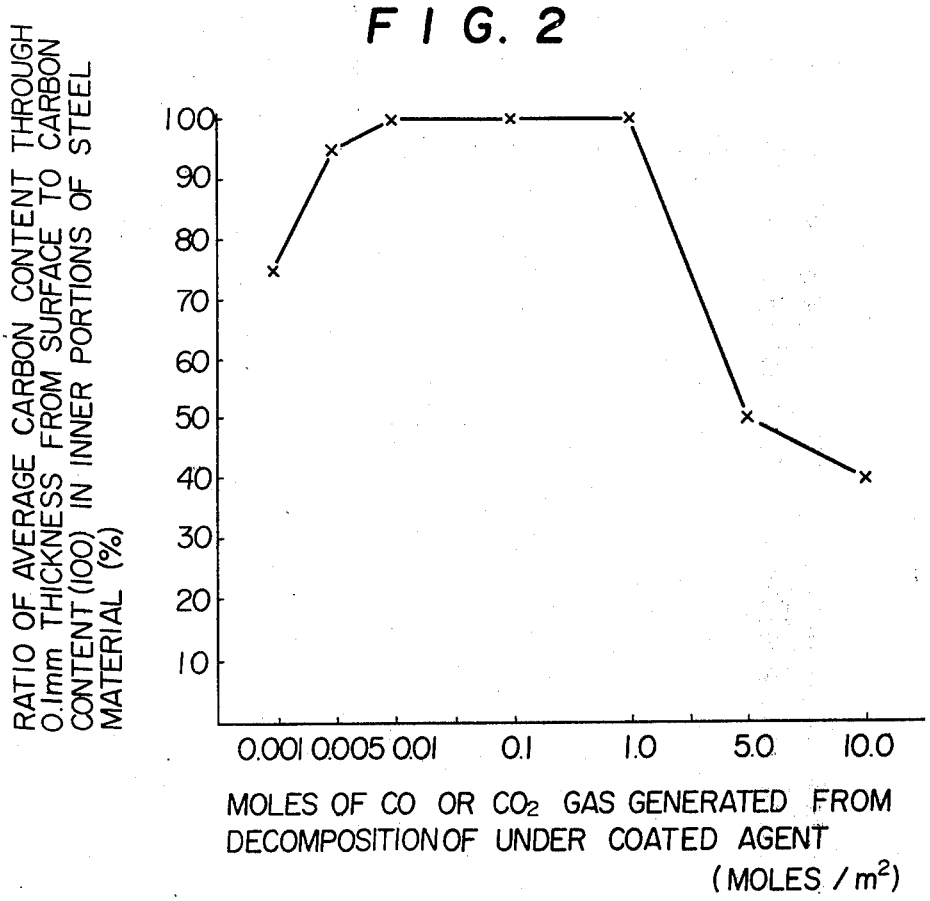
FIG. 2 is a graph showing the dependance of surface decarburization upon the amount of the CO or $CO_2$ produced by decomposition of a compound contained in the base coating.

In practicing the invention, it is to be understood from FIG. 2 that preferable base-coating weights are in a range of 0.005–5.0 mole/$m^2$ in terms of the amount of CO or $CO_2$ produced during heat treatment. When the coating weight is less than 0.005 mole/$m^2$, a loss of the produced CO or $CO_2$ by diffusion through the over-coating breaks the level of the necessary amount of CO or $CO_2$ for the complete prevention of decarburization during the intended heat treatment. When the coating weight is more than 5 moles/$m^2$, the over-coating of whatever thickness is broken by a large gas pressure of CO or $CO_2$, and almost all the produced CO or $CO_2$ is allowed to leak away through the brokened portions, so that neither decarubrization nor oxidation can be effectively prevented. It is necessary to apply the over-coating in a coverage sufficient to effect as good an antioxidation of the steel surface as possible.

A further advantage is that the coating of the invention has an antioxidizing effect so that the amount of scale formed is decreased with an increase in the yield of steel products. This advantage is particularly important in the process of producing silicon steel sheet and strip, because bare silicon steel, when subjected to heat treatment, tends to produce $2FeO.SiO_2$ in the form of slag which flows down to exert an adverse influence upon the heat treatment operation in the furnace.

In order to accomplish the second object of the present invention, a metal to be treated is first coated with a diffusion coating composition and then is over-coated with a specified composition, described hereinafter which is capable of shielding the atmosphere of the space between the metal surface and the over-coating from an environmental atmosphere, in most cases, atmospheric air in which the heat treatment operation is carried out. In the case of nitriding, the diffusion coating composition is formulated to contain ammonium sulfate $(NH_4)_2SO_4$ dispersed in a minor amount of a binder. The ammonium sulfate when heated in the heat treatment undergoes dissociation to provide nitrogen gas with which the space under the over-coating is saturated, thereupon producing an atmosphere of nitrogen around the metal surface being prepared. In the process by which metallic element is diffused into a base metal, the diffusion coating composition is formulated to contain a diffusing metallic element and ammonium chloride $NH_4Cl$ dispersed in a minor amount of a binder. The ammonium chloride when heated in the heat treatment provides hydrogen chloride (HCl) gas with which the space between the metal surface and over-coating is saturated, thereby providing the added advantage of protecting the equipment for use in the heat treatment operation from corrosion by corrosive HCl gas. In the prior art process by which a metallic element placed in an atmosphere of HCl gas is diffused into a base metal, the equipment corrosion is unavoidable.

From the foregoing description, it will be appreciated that in practicing the present invention, the over-coating applied on the diffusion coating should be able to completely shut out the atmospheric air at high temperatures. In order to impart such properties to the over-coating, it has been found from the analysis of experimental data that it is preferred that the over-coating composition comprise;

1. 1–20 parts by weight of $Cr_2O_3$;
2. 1–20 parts by weight of one or more reducing agents selected from Al, Zn, Cu, Ni, Co, Mn, Gm, Fe, Cr, Ti, Zr, Sr, Mo, Sn, In, C, $Fe_2O_3$ and FeO;
3. 5–80 parts by weight of one or more clays or refractories selected from silica powder, kaolin, magnesia powder, montmorillonite, $MgO-Cr_2O_3$ refractories, $MgO-SiO_2$ refractories and dolomite;
4. 5–120 parts by weight of silicic acid anhydride;
5. 5–120 parts by weight of water glass; and
6. Water in an amount such that the resultant composition has a desired viscosity.

The above-specified composition may further contain 0.5–5 parts by weight of bentonite for improvement of the removeability of the over-coating in the hot rolling operation.

Consideration will be now given to the functions that the ingredients contribute to the atmospheric air excluding performance of the over-coating. Assuming that the over-coating is of a $Cr_2O_3$-kaolin-Al-$SiO_2$—water glass system, the water glass itself takes the form of very intimate film at temperatures below about 400°C so that the penetration of oxygen by diffusion from the outside is sufficiently inhibited. The water glass film, when heated to a temperature between 400°–450°C, undergoes a transformation, while a semi-fused hard clay film is formed in the temperature range. As the temperature increases, the diffusion rate of oxygen increases, but the oxygen entering the over-coating is allowed to react with the aluminum reducing agent, thereby being prevented from reaching the diffusion coating. The semi-fused hard clay coating also assists in the prevention of the oxygen from diffusing therethrough. The silicon dioxide serves to control the hardness of the overcoating so that the volume expansion effected in the base steel by heating to a temperature of more than 1000°C does not cause formation of cracks in the over-coating. Usually water glass is composed of $Na_2O$ and $SiO_2$, and the viscosity of water glass depends upon the mixture ratio of $Na_2O$ to $SiO_2$. For example, $2Na_2O.\ SiO_2$ has a viscosity of 1.0 poise at 1400°C; $Na_2O.\ SiO_2$:1.6 poises; $Na_2O$: $2SiO_2$: 280 poises and pure $SiO_2$:$1 \times 10^{10}$ poises. For this reason, it is preferred to adjust the rate of $Na_2O$ to $SiO_2$ in the resultant composition to 0.005–0.3. The incorporation of very finely divided $Cr_2O_3$ makes the coating more intimate and improves the removeability of the coating in the rolling operation. In other words, in the process of producing steel sheet and strip from slabs or billet in accordance with the present invention, the coating of the heat-treated slab or billet has to be almost completely removed therefrom during the rolling operation. The presence of $Cr_2O_3$ in the coating is effective for the removebility. The increased removability of the coating of the invention provides an advantage over a certain prior art heat treatment procedure in a protective atmosphere which comprises packing a metal to be treated in a box made from thin plates, sealing the box by welding and heating the box. In this case, the removal of the box from the treated metal is very time-consuming.

Figure 4:
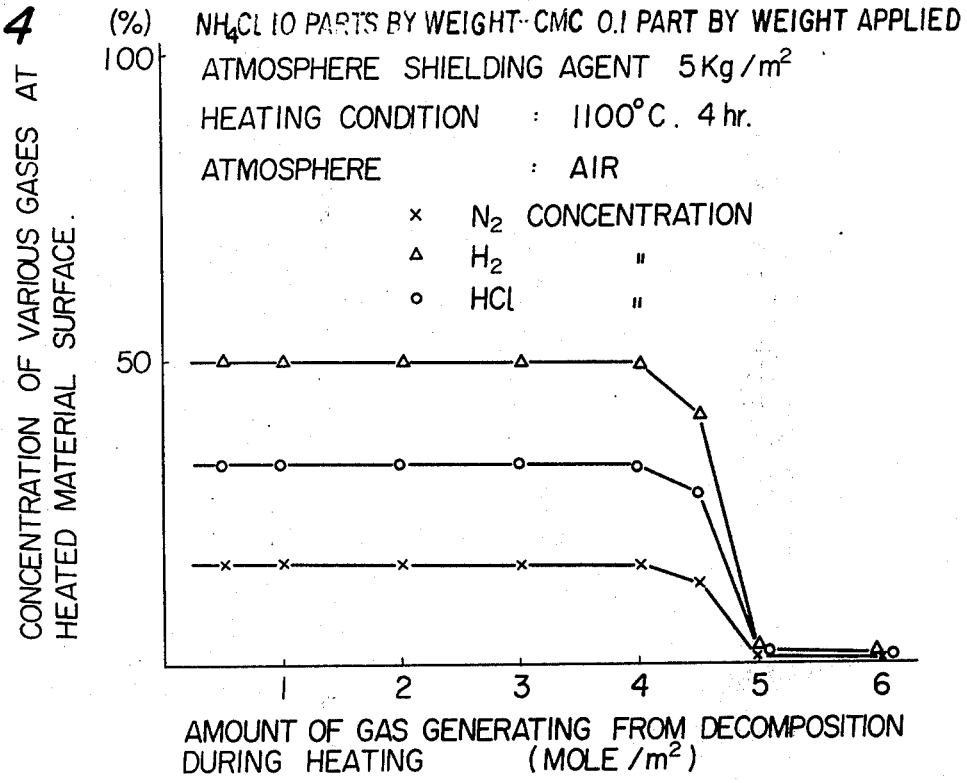
FIG. 4 is a graph showing variations of concentration of the gases in the surface atmosphere in accordance with base-coating weight (in terms of the total amount of the gases produced during heat treatment).
Figure 5:
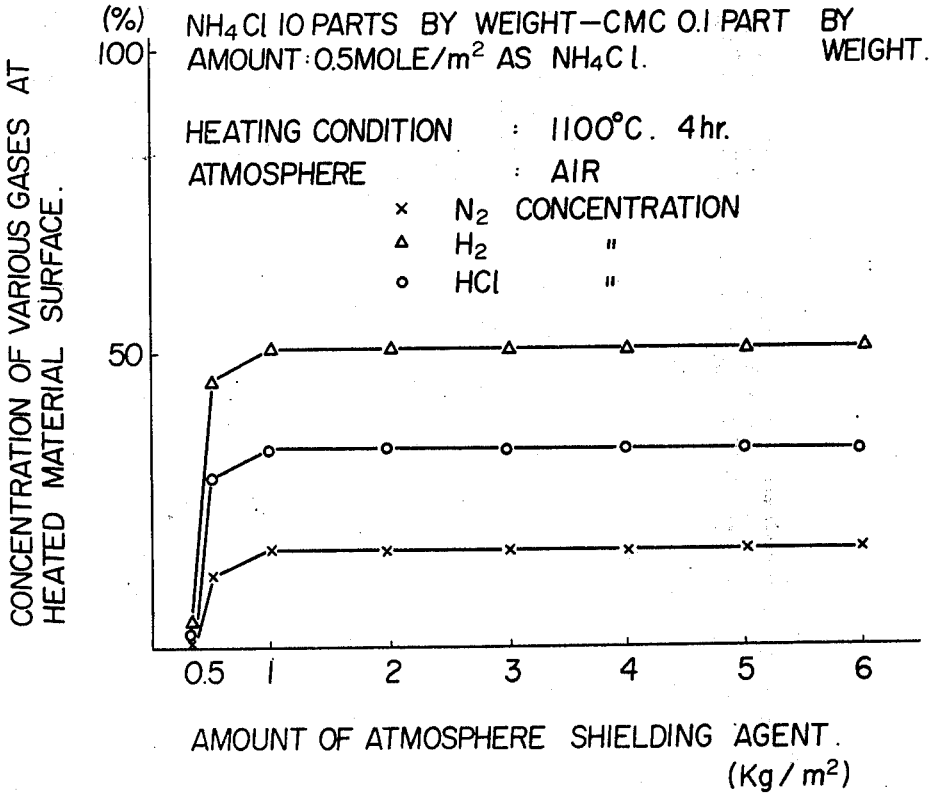
FIG. 5 is a graph showing variations of concentration of gases in the surface atmosphere in accordance with over-coating weight.

As is evident from FIG. 4, it is preferred to limit the base coating weight to less than 5 mol/m² in terms of the total amount of the gases produced during heat treatment. This is because the over-coating of a given thickness is broken by the expansion of the produced gases, when the coating weight exceeds the limit. As is evident from FIG. 5, it is necessary to apply the over-coating in a coating weight of more than 0.5 Kg/m². The over-coating of less than 0.5 Kg/m² is insufficient to exclude the atmospheric air and to keep the produced gases around the surface of the metal to be treated.

Figure 6:
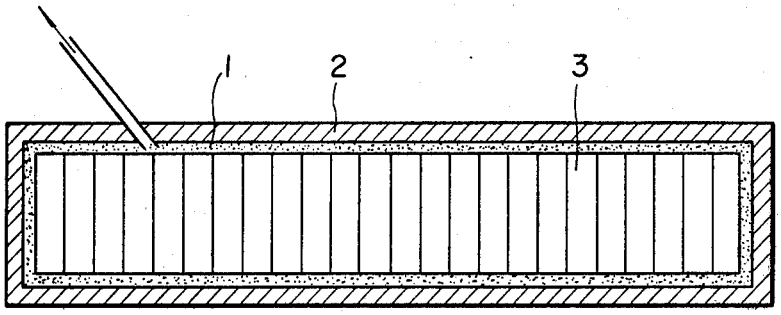
FIG. 6 is a sectional view of the coated steel and shows a method of extracting the gases from the surface atmosphere for the purpose of gas analysis.
Figure 7:
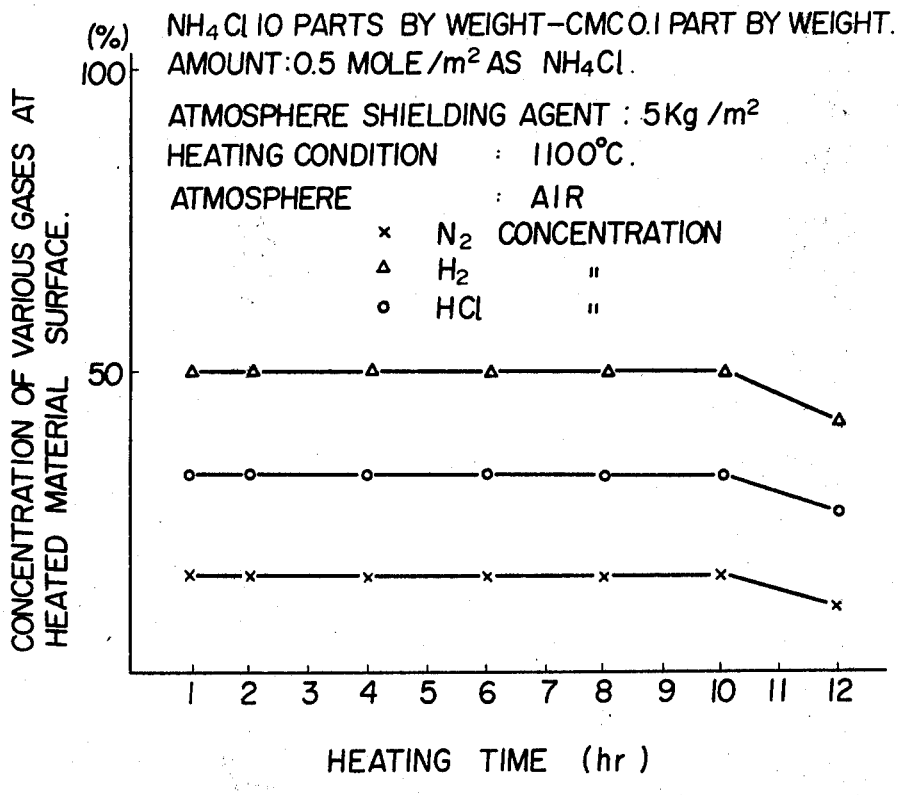
FIG. 7 is a graph showing variations of concentration of gases in the surface atmosphere with time.

In order to investigate which gases are produced in the space between the metal surface and the over-coating, and how long the gaseous composition is maintained constant, an analytical experiment was carried out using a specimen of which the cross section is illustrated in FIG. 6 as comprising a diffusion coating 1 and an over-coating 2 successively applied on the surface of a slab 3. The diffusion coating composition comprises 10 parts by weight of $NH_4Cl$ and 0.2 part by weight of CMC and is applied in a coating weight of 0.5 mol/m² in terms of $NH_4Cl$. The over-coating composition comprises 20 parts by weight of $Cr_2O_3$, 30 parts by weight of kaolin, 7 parts by weight of aluminum, 20 parts by weight of water glass and 40 parts by weight of $SiO_2$, and is applied in a coating weight of 5 kg/m². It is to be understood from FIG. 7 that the surface of the slab is exposed to a special atmosphere for an extremely long length of time.

Figure 8:
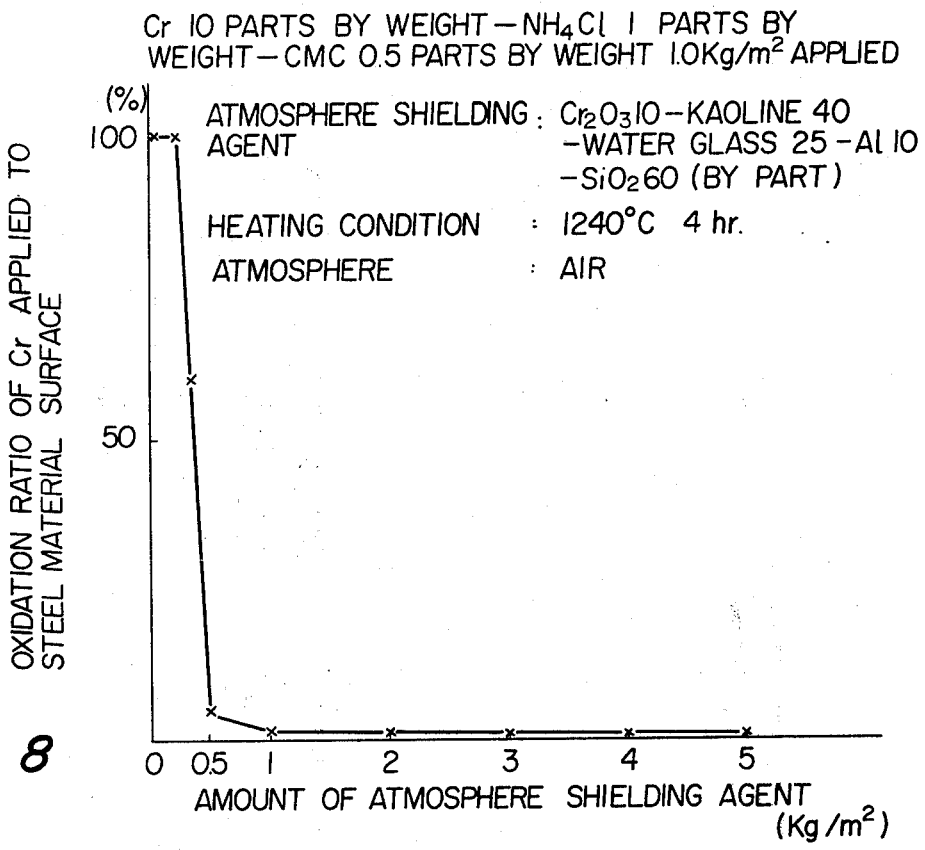
FIG. 8 is a graph showing a relationship between the percentage of oxidized chromium in the diffusion coating and the over-coating weight.

In the process by which a metallic element or carbon is caused to diffuse into a base metal, the diffusion coating composition is formulated to contain the powdered metallic element or carbon along with a halide capable, upon heating, of evolving hydrogen halide gass or halogen gas, both components being preferably dispersed in a binder, such as, water glass, CMC, PVA and other suitable water-soluble resins. As the diffusing metallic element, use may be made of Mg, Al, Si, Cu, Se, Ti, V, Cr, Mn, Fe, Co, Ni, Ca, Zn, Ga, Ge, As, Sr, Zr, Nb, Mo, Ag, Cd, Sn and Ba. The over-coating of the above-specificated composition may be applied without modification although corrosive HCl gas is produced in the underlying diffusion coating during heat treatment. For protection of the powdered metallic element from oxidation at high temperatures, the over-coating weight should be more than 0.5 kg/m² as can be seen from FIG. 8. In order to effect uniform diffusion and high speed penetration of the element into the base metal, the rate of the halide to the metallic element in the diffusion coating is preferably as follows;

For chlorides capable of producing HCl gas:

$$\frac{\text{The number of moles of the produced HCl}}{\text{The number of moles of the diffusing element}} = 0.005 \text{ and greater}$$

For chlorides capable of producing $Cl_2$ gas:

$$\frac{\text{The number of moles of produced } Cl_2}{\text{The number of moles of the diffusing element}} = 0.0025 \text{ and greater}$$

When the above-defined lower limits are violated, the diffusing element is liable to be concentrated in the grain bounderies, and a decreased penetration speed is effected as shown in Tables 1 and 2. Such situations are also valid for other halides.

Table 1

| HCl/Cr (in mole) | 0.001 | 0.004 | 0.005 | 0.01 | 0.5 | 1.0 | 5.0 | 10.0 | 100.0 |
|---|---|---|---|---|---|---|---|---|---|
| | x | Δ | o | o | o | o | o | o | o |

Table 2

| $Cl_2/Cr$ (in mole) | 0.001 | 0.002 | 0.0025 | 0.005 | 0.01 | 0.1 | 1.0 | 10.0 | 100.0 |
|---|---|---|---|---|---|---|---|---|---|
| | x | Δ | o | o | | o | o | o | o |

Condition:

The diffusion coating : Cr + $NH_4Cl$ in 0.5 kg/m²

The over-coating : $Cr_2O_3$-chamotte-Zn-$SiO_2$-water glass

Heat treatment : 1250°C for 4 hours.

Criterion:

*x* : Almost all the diffused element is concentrated in the grain boundaries;

Δ : Some of the diffused element is concentrated in the grain boundaries;

*o* : Uniform diffusion is effected.

Figure 9:
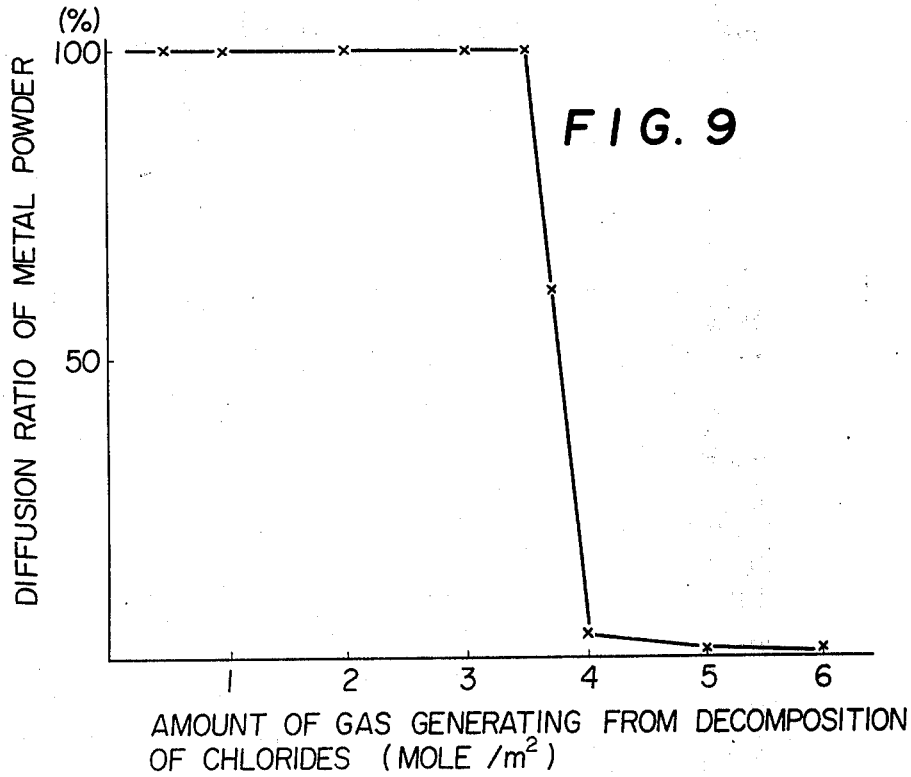
FIG. 9 is a graph showing a relationship between the percentage of diffused metallic element and the amount of a gas produced by decomposition of a chloride.

The total amount of halide added should be restricted to such a value that the total amount of the gas produced by dissociation of the chloride during the heat treatment is less than 4 moles/m². When more than 4 moles/m² of gas is produced, the over-coating is damaged by the expansion of the gas so that the diffusing element powder is subjected to oxidation as shown in FIG. 9.

Figure 15:
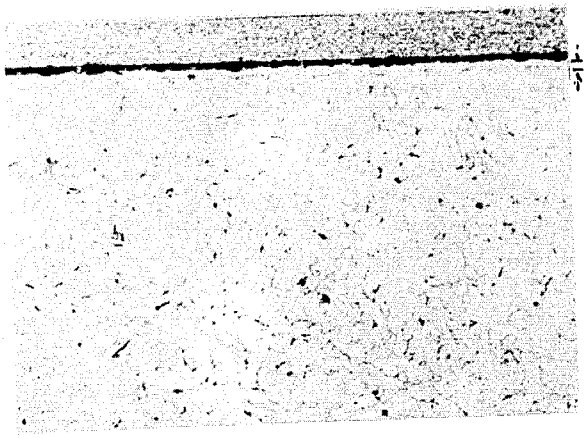
FIG. 15 is an electromicrograph of the cross section of a steel sheet produced in accordance with the invention.
Figure 17:
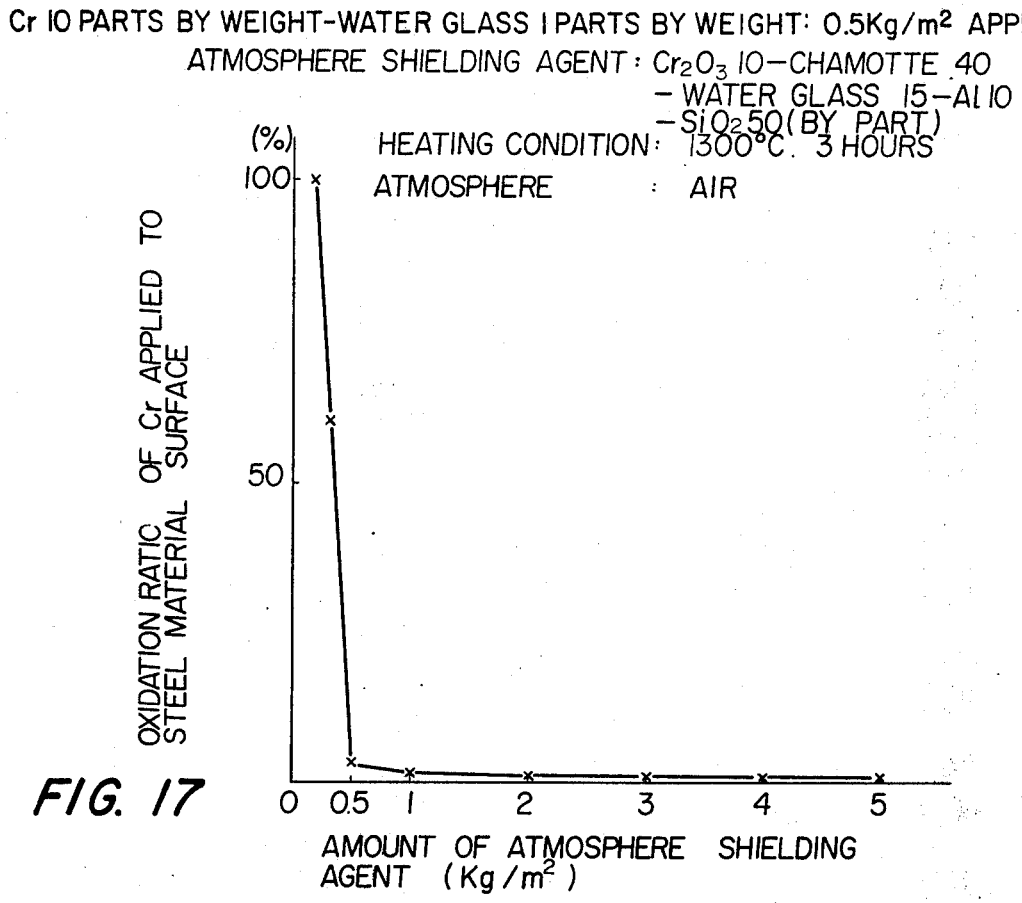
FIG. 17 is a graph showing a relationship between the percentage of oxidized chromium and the over-coating weight.
Figure 16:
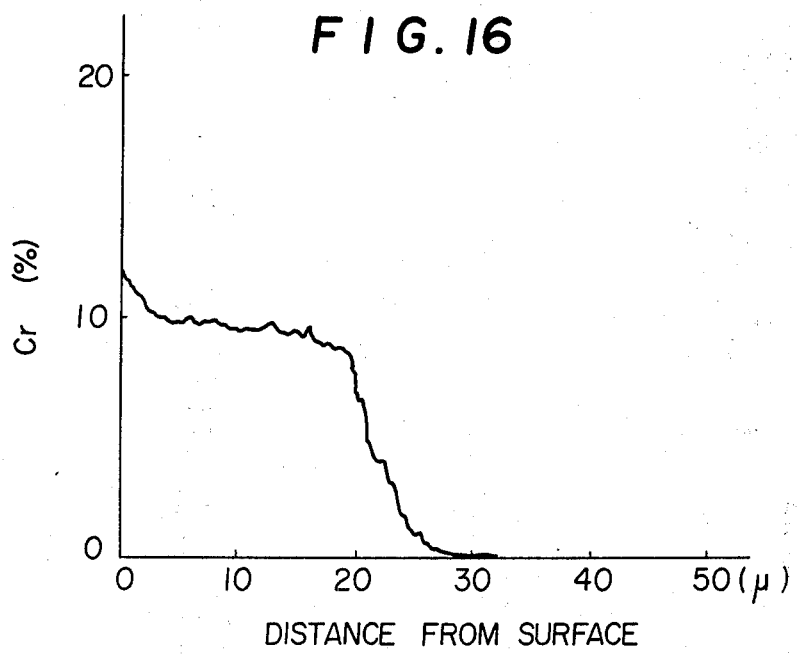
FIG. 16 is a graph showing variation of chromium content with depth in a chromized steel measured by using an X-ray microanalyzer.

In the chromizing in accordance with the present invention, a diffusion coating composition is made containing 10 parts by weight of chromium powder dispersed in 2 parts by weight of water glass, and is applied on the surface of a steel slab of 200 mm thickness, precleaned by shot-blasting in a coating weight of 0.5 kg/m². The steel slab so coated is further coated with an atmospheric air excludable coating composition comprising 10 parts by weight of $Cr_2O_3$, 40 parts by weight of chamotte, 30 parts by weight of water glass, 10 parts by weight of aluminum and 60 parts by weight of $SiO_2$ at a coverage of 4 kg/m². After being dried, the steel slat is subjected to a heat treatment at 1300°C for 4 hours in an uncontrolled atmosphere of a furnace and then to a rolling operation of a 10 mm thick sheet. A microphotograph (×50) of the cross section of the chromized steel sheet is shown in FIG. 15, in which a diffused layer of an alloy of chromium and iron formed on the surface of the steel sheet can be recognized. In FIG. 16, an X-ray microanalysis of the diffused layer shows that chromium is caused by the above process to diffuse to a depth of 20 microns with a 10% chromium content. If such a result is to be effected, the over-coating should be applied at a coverage of more than 0.5 kg/m² as can be seen from FIG. 17.

As will be seen from the foregoing description, the heat treatment in the process of the present invention may be carried out at far higher temperatures to reduce the treatment period as compared with conventional processes requiring large volumes of a prepared atmosphere thereby providing an advantage with respect to the speed up of the process operation.

Another advantage is that the step of the heat treatment of the invention may be incorporated prior to the step of rolling treatment in the conventional process of manufacturing steel products having an alloy case on the surface thereof.

Figure 23:
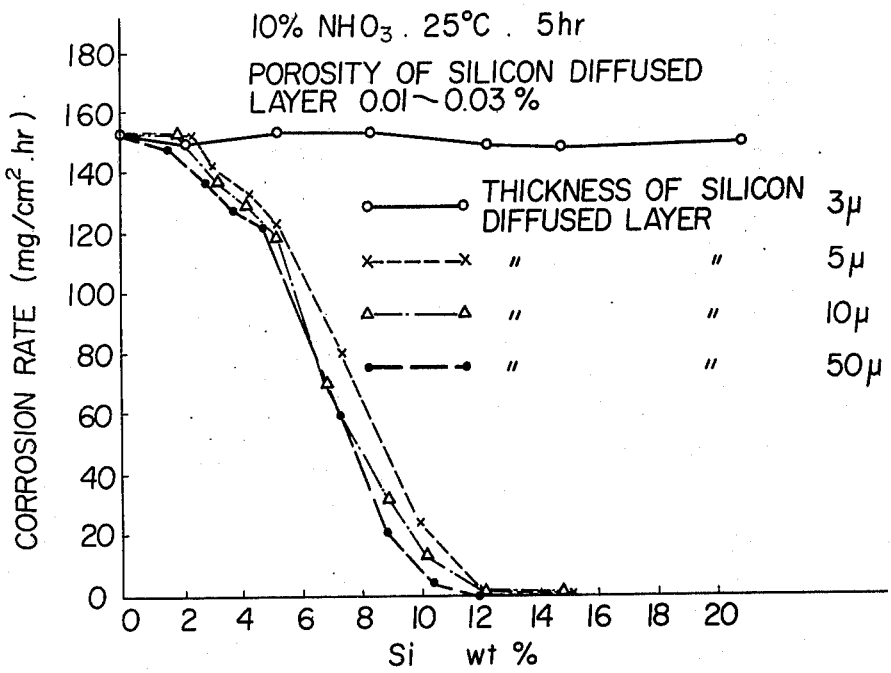
FIG. 23 is a graph showing the dependence of acid resistance of a siliconized steel on the thickness and silicon content of the diffused layer thereof.
Figure 24:
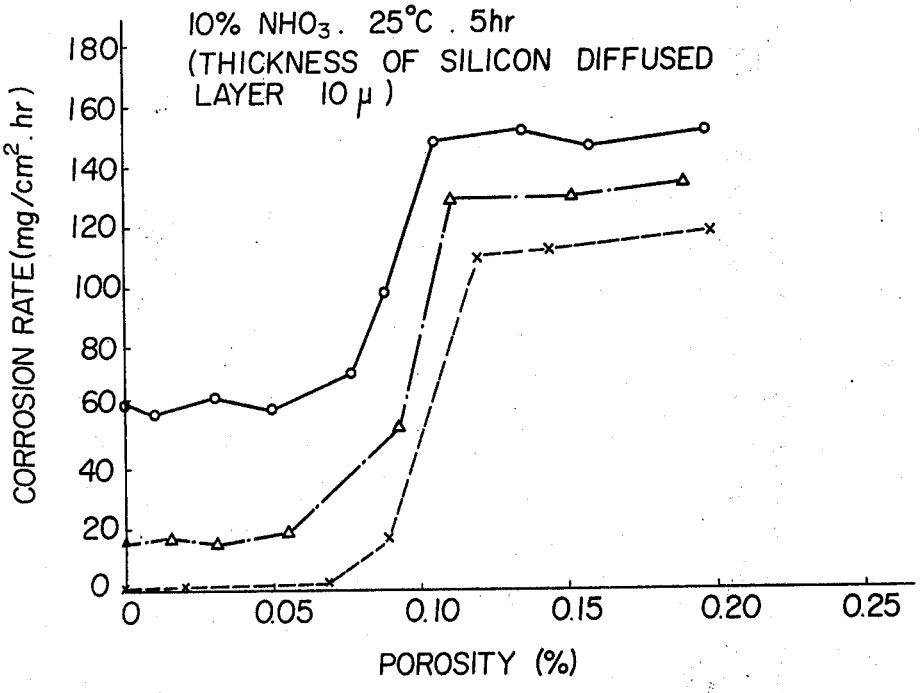
FIG. 24 is a graph showing the dependence of the acid resistance of a siliconized steel sheet on the porosity of the diffused layer thereof.
Figure 27:
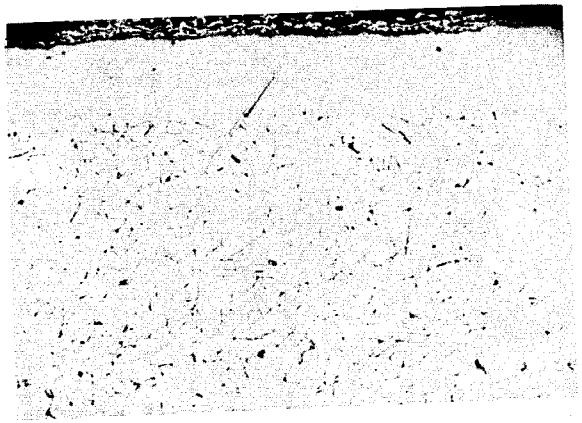
FIGS. 25, 26, 27 and 28 are electronmicrographs of the cross sections of siliconized steel sheets produced according to Examples 16, 17 and 19, and Control 7, respectively.
Figure 28:
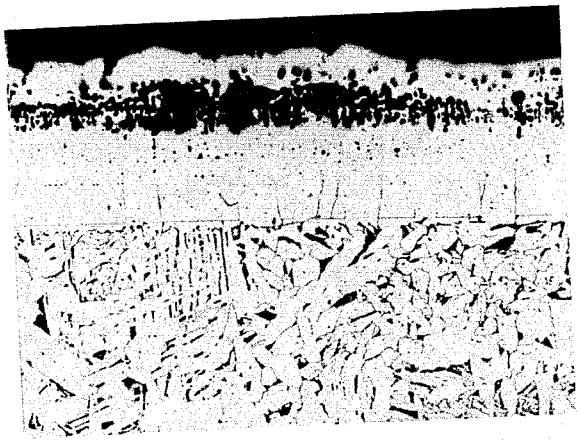

In order to accomplish the third and fourth objects of the present invention, it is essential to combine the siliconizing procedure in an uncontrolled atmosphere with the subsequent hot-rolling treatment. The siliconizing procedure of the invention may be carried out by utilizing conventional powder pack method, vapor phase method, or other suitable method. But these conventional methods require specially closed containers or specially prepared furnace atmospheres, and the processes for performing these methods are neither economical nor simple. Unlike the prior art process, the process described in connection with the accomplishment of the second object of the present invention is advantageously applied to the siliconizing procedure in which a diffusion coating containing silicon-bearing material is applied on the surface of a steel to be treated, and an over-coating of the above-mentioned composition is then applied thereon, the steel slab thus coated is heated in an atmospheric air or combustion gas atmosphere as in a slab-heating furnace for use in the usual hot-rolling operations. It is to be understood from the above that according to the invention, the siliconizing treatment is very economically carried out by using inexpensive coating materials and employing a simple coating technique and a usual furnace. As the silicon-bearing material, use may be made of a mixture of silicon powder and ammonium chloride. The depth of the silicon-diffused layer and the silicon content therein can be controlled by varying the rate of silicon powder to ammonium chloride and the coating weight in accordance with the temperature and time of the heat treatment. In order to produce corrosion-resistant siliconized steels, it is very important to subject the treated steel to a hot-rolling treatment. The application of the hot-rolling treatment to the heat treated steel makes the silicon-diffused layer non-porous, and in addition, it facilitates the formation of small crystal grains in the base steel. The siliconized steel usually has a porous diffused layer at the surface, the porosity being more than 3%. This is the main reason why the siliconized steel has never been used as a corrosion-resistant steel. We have now found that by subjecting the siliconized steel to a hot-rolling treatment in 5% reduction at a finish-rolling temperature higher than this $Ar_3$ poiht, the porosity can be decreased to less than 0.1%, and the corrosion resistance of the resulting steel product is remarkably improved as shown in FIG. 24. In order to impart improved mechanical properties to the resultant hot-rolled steel products, it is necessary to perform the hot-rolling operation in thickness reduction of more than 30% at a finish-rolling temperature ranging from $Ar_3$ point to $Ar_3$ point +100°C, whereby the formation of uniform crystal grains with sizes of less than ASTM No. 5 is effected. When the finish temperature is lower than $Ar_3$ point, not only gamma- and alpha- crystals are formed simultaneously but also small cracks sometimes occur in the diffused layer. When the finish temperature exceeds the $Ar_3$ point +100°C, the size of the crystal grains increases to more than ASTM No. 5 with a decrease in the elastic limit and tensile strength. The corrosion-resistance of the siliconized steel depends upon not only the porosity but also the depth of the difused layer and the silicon content as shown in FIG. 23. The upper limit of the range of acceptable thickness of the diffused layer is herein defined as 1000 microns by taking into account the embodiment of an economical process and the secondary fabricating application. In other words, as the depth increases, the siliconizing temperature and length of time increase to more than 1350°C and 6 hours, for example, and in the secondary fabricating application, the stripping off and cracking are caused in the diffused layer. The upper limit of the silicon content is herein defined as less than 53%, or otherwise the diffusion coating weight, siliconizing temperature and time are necessarily increased. Practical examples are shown in Table 3.

Table 3

| Sample | Heating Condition Temp. (°C) | Heating Condition Time (hr) | Coverage (kg/cm²) | Hot-rolling Condition: Thickness of semi-finished steel sheet(mm) | Hot-rolling Condition: Thickness of rolled steel sheet(mm) | Hot-rolling Condition: Reduction (%) | Hot-rolling Condition: Finish-rolling Temperature(°C) |
|---|---|---|---|---|---|---|---|
| A | 1220 | 6 | 0.7 | 230 | 3.2 | 98.6 | 880 |
| B | " | 4 | " | " | " | " | " |
| C | " | 2 | " | " | " | " | " |
| D | " | 1 | " | " | " | " | " |
| E | 1150 | 4 | 0.7 | 180 | 4.5 | 97.5 | 850 |
| F | 1200 | " | " | " | " | " | 860 |
| G | 1250 | " | " | " | " | " | 880 |
| H | 1300 | " | " | " | " | " | 900 |
| I | 1350 | 6 | 0.5 | 230 | 2.0 | 99.1 | 870 |
| J | " | " | 0.7 | " | " | " | " |
| K | " | " | 1.0 | " | " | " | " |
| L | " | " | 2.0 | " | " | " | " |
| M | " | " | 3.0 | " | " | " | " |
| N | " | " | 4.0 | " | " | " | " |
| O | 1220 | 4 | 0.7 | 180 | 45 | 75 | 870 |
| P | " | " | " | " | 90 | 50 | 890 |
| Q | " | " | " | " | 135 | 25 | 870 |
| R | " | " | " | " | 162 | 10 | " |
| S | " | " | " | " | 171 | 5 | 880 |
| T | " | " | " | " | 175 | 3 | 890 |
| U | Corrosion amount of SS41 steel | | | | | | |

| Silicon-diffused layer: Depth (μ) | Silicon-diffused layer: Si-content(%) | Silicon-diffused layer: Porosity (%) | Corrosion amount in 10% $HNO_3$ at 25°C for 5 hrs. (mg/cm² hr.) | Structure of rolled base steel | |
|---|---|---|---|---|---|
| 10 | 15 | 0.010 | 0.41 | Fine grain of | No.8 |
| 8 | 20 | " | 0.02 | " | |
| 6 | 36 | 0.005 | 0.01 | " | |
| 4 | 34 | " | 149 | " | |
| 10 | 14 | 0.010 | 0.64 | " | No.7 |
| 13 | 18 | 0.025 | 0.02 | " | |
| 16 | 19 | " | " | " | No.8 |
| 21 | 13 | " | 0.85 | " | |
| 12 | 5 | 0 | 118 | " | No.8 |
| " | 7 | " | 89 | " | |
| " | 11 | " | 12 | " | |
| 11 | 29 | " | 0.015 | " | |
| " | 53 | " | 0.005 | " | |
| 12 | 52 | " | 0.003 | " | |
| 150 | 19 | 0.050 | 0.02 | " | No.5 |
| 295 | 20 | 0.070 | " | " | |
| 440 | " | 0.075 | 0.017 | Rough grain of | No.4 |
| 530 | 18 | 0.080 | 0.022 | " | No.3 |
| 560 | 21 | 0.090 | 0.01 | " | No.1 |
| 570 | 19 | 0.150 | 152 | " | |

Note:
The Si-diffusion coating composition comprises 10 parts by weight of silicon powder and 0.5 part by weight of $NH_4Cl$ dispersed in a binder and water. The over-coating compositon is of a $CR_2O_3$-refractory (or clay) - reduction agent-$SiO_2$-water glass system.

Figure 29:
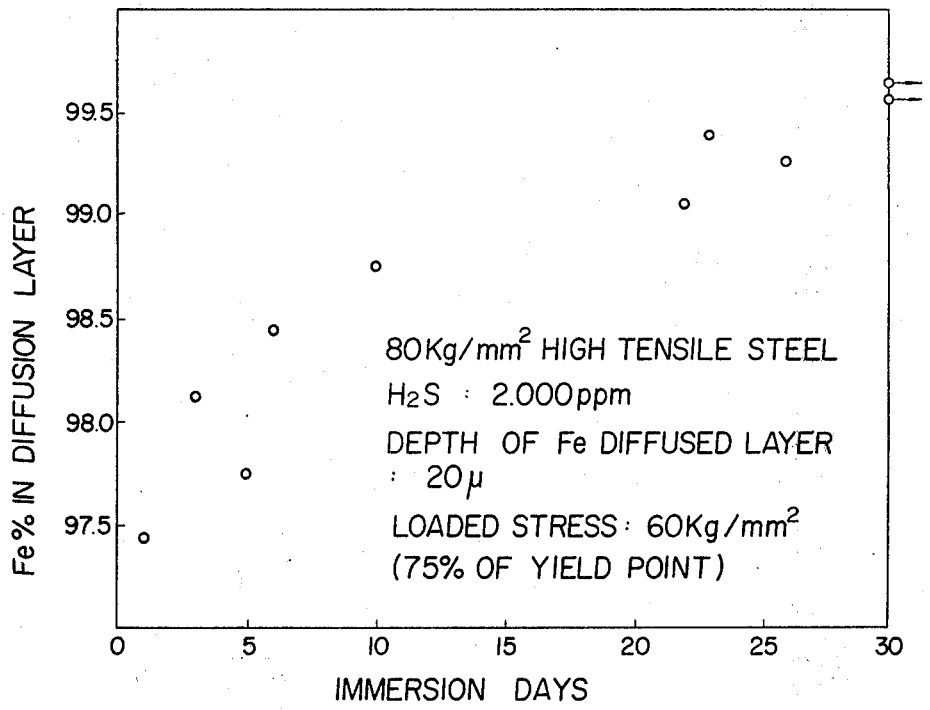
FIG. 29 is a plot of the concentration of iron in the diffused layer versus the period in which a crack is detected.
Figure 30:
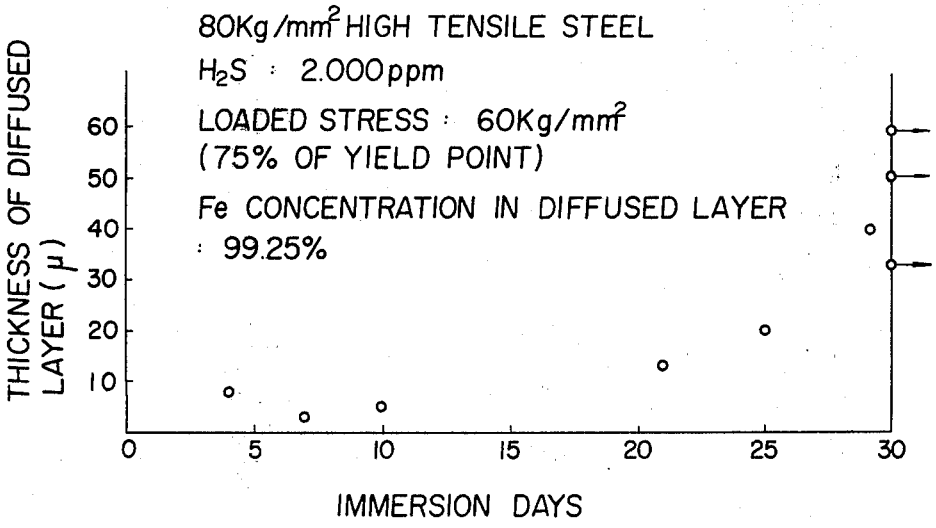
FIG. 30 is a plot of the thickness of the iron-diffused layer versus the period in which a crack is detected.

In order to accomplish the fifth object of the present invention, the diffusion coating composition is formulated to contain pure iron powder dispersed in a binder or a mixture of pure iron powder and a halide dispersed in a binder, and is applied to the precleaned surface of a steel slab or billet to be treated. As the pure iron powder, use may be made of reduced iron, electrolytic iron subjected to dehydrogenation. The over-coating may be of commercially available scale inhibitor or antioxidant, but the abovementioned atmospheric air-excludable coating composition is advantageously used. The depth of the iron-diffused layer and the iron content therein of the resulting rolled steel sheet can be controlled by varying the ratio of the diffusing iron to the halide in accordance with the temperature and time of heat treatment. In order to impart increased stress-corrosion cracking resistance to the resulting hot-rolled steel sheet, the depth and iron content are necessarily greater than 10 microns and 99% respectively as shown in FIG. 29 and FIG. 30, wherein the stress corrosion cracking resistance test was carried out using a number of high tension steel specimens of 25 mm thick and having the composition and mechanical properties tabulated in Tables 4 and 5 respectively immersed in a corrosive aqueous solution containing 0.5% acetic acid and 2000 ppm of $H_2S$ under a load of 60 kg/mm² (0.75 times the yield point). When the iron-diffused layer was excluded from the surface of steel specimens of the above specification, the cracking was caused in 2 days in all the specimens.

Table 4

| C | Si | Mn | P | S | Ni | Cr | Cu | Mo |
|---|---|---|---|---|---|---|---|---|
| 0.14 | 0.31 | 1.10 | 0.012 | 0.011 | 1.20 | 0.49 | 0.31 | 0.51 |

Table 5

| Yield Point (kg/mm²) | Tensile Strength (kg/mm²) | Elongation (%) | Yield ratio |
|---|---|---|---|
| 80.2 | 84.3 | 41.7 | 0.95 |

The present invention will be further illustrated by the following examples in which all parts are parts by weight unless otherwise specified.

EXAMPLE 1

Figure 3:
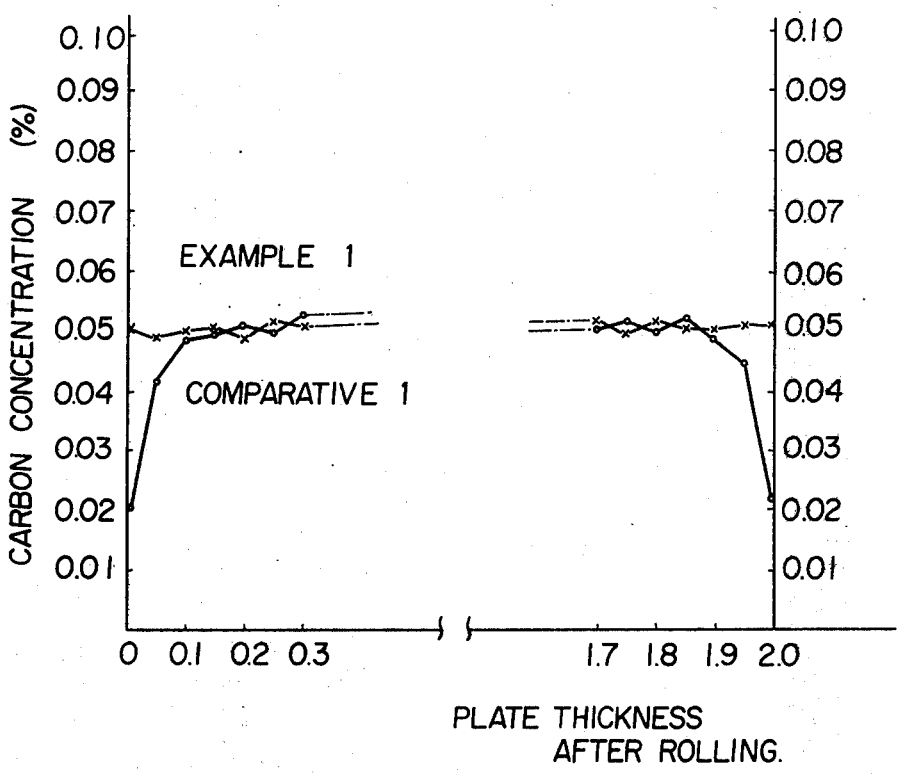
FIG. 3 is a graph showing different effects on decarburization between Example 1 and Control 1.

A dispersion containing 10 parts of carbon powder in 3 parts of water glass was applied on the surface of a slab containing 3% silicon in a coating weight of 0.5 kg/m², and over it was applied a coating of an antioxidant available in the market. The slab thus coated was heated to 1300°C for 4 hours and was then rolled. The surface of the resultant steel sheet was analyzed and the results are shown in FIG. 3. It is to be understood from FIG. 3 that the percentage of carbon at the surface is the same as that of the inner portion, and that no decarburization had occurred during the heat treatment.

EXAMPLE 2

Potassium carbonate was applied on the surface of a steel slab at a coverage of 0.01 kg/m², and over it was applied an antioxidant available in the market. The slab so coated was heated to 1150°C for 5 hours and was then rolled. The chemical analysis showed that no decarburization had occurred during the heat reatment.

EXAMPLE 3

A dispersion containing 10 parts of manganese carbide in 3 parts of water glass was applied on the surface of a slab containing 3% silicon at a coating weight of 1 kg/m², and over it was applied an antioxidant coating of a sufficient thickness. The slab so coated was heated to 1350°C for 4 hours and was then rolled. No decarburization was detected by chemical analysis.

EXAMPLE 4

A water-soluble melamine resin was applied on the surface of a steel slab in a coating weight of 0.02 kg/m², and over it was applied an antioxidant coating. The slab so coated was heated to 1200°C for 5 hours and was then rolled. No decarburization was detected by the chemical analysis.

CONTROL 1

A number of bare steel slabs each containing 3% silicon were heated to 1300°C for 4 hours and were then rolled to produce silicon steel sheets of different thickness. Their surfaces were analyzed and the results are shown in FIG. 3. It is to be understood that decarburization had occurred to some extent at the surfaces during the heat treatment.

CONTROL 2

An antioxidant was applied on the surface of a slab containing 3% silicon. The coated slab was heated to 1280°C for 4 hours, and was then rolled. The chemical analysis showed that some decarburization had occurred during the heat treatment although the amount was smaller than in Control 1.

EXAMPLE 5

A mixture containing 10 parts of ammonium sulfate and 1 part of water glass was applied on the surface of a steel part at a coating weight of 1 mole of ammonium sulfate per square meter, and over it was applied an over-coating of $Cr_2O_3$, 15-chammotte 20-water glass 25-Al, 5-$SiO_2$, 80 at a coating weight of 5 kg/m². The steel part thus coated was heated to 1000°C for 5 hours. The surface atmosphere was determined by gas analysis as comprising almost 100% nitrogen and hydrogen, and other gases, such as, oxygen could not be detected.

EXAMPLE 6

A mixture containing 10 parts of $NH_4Cl$ and 0.1 part of CMC was applied on the surface of a steel part at a coating weight of 4 moles $NH_4Cl/m^2$, and over it was applied a coat of $Cr_2O_3$ 10-chamotte 40-water glass 20-Zn 10-$SiO_2$ 60 at a coating weight of 4 kg/m². The coated steel part was heated to 1100°C for 7 hours. The gaseous composition of the surface atmosphere was determined by gas analysis as comprising almost 100% nitrogen, hydrogen and chlorine gas, and other gases, such as, oxygen could not be detected during the heat treatment.

EXAMPLE 7

A mixture containing 10 parts of $Na_2CO_3$ and 0.2 part of PVA was applied on the surface of a steel part at a coating weight of 0.7 mole $Na_2CO_3/m^2$, and over it was applied a coat of $Cr_2O_3$ 5-chammote 30-water glass 15-Al 3-$SiO_2$ 30 at a coating weight of 3.5 kg/m². The coated steel part was heated to 1050°C for 4 hours. The gaseous composition of the surface atmosphere was determined by gas analysis as comprising almost 100% of $CO_2$, and other gases, such as, oxygen and nitrogen could not be detected during the heat treatment.

CONTROL 3

A mixture containing 10 parts of ammonium sulfate and 1 part of water glass was applied on the surface of a steel part in a coating weight of 0.8 mole $(NH_4)_2SO_4/m^2$, and over it was applied a commercially available antioxidant at a coating weight of 5 kg/m². The coated steel part was heated to 1000°C for 5 hours. The gaseous composition of surface atmosphere was determined by the gas analysis as comprising nitrogen, hydrogen and oxygen, and it was found that the concentration of oxygen increased as the length of time increased.

EXAMPLE 8

Figure 10:
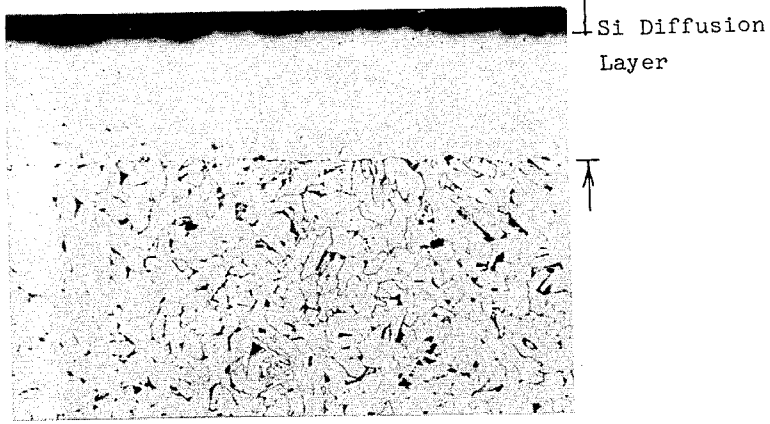

After the surface of a steel slab was cleaned by shot-blasting, a mixed powder of 10 parts of silicon and 1 part of $NH_4Cl$ was applied on the slab surface in a coverage of 1 kg/m$^2$, and over it was applied a coat of $Cr_2O_3$ 10-montmorillonite 20-water glass 20-Al 5-$SiO_2$ 60 at a coating weight of 5 kg/m$^2$. The slab thus coated was heated to 1300°C for 5 hours in a furnace atmosphere and was then rolled to produce a steel sheet. An electronmicrophotograph of the cross-section of the steel sheet is shown in FIG. 10. The variation of silicon line spectrum with depth was measured by X-ray microanalysis, and it was found that uniformly diffused layer with 20% silicon content was formed at the surface.

EXAMPLE 9

Figure 11:
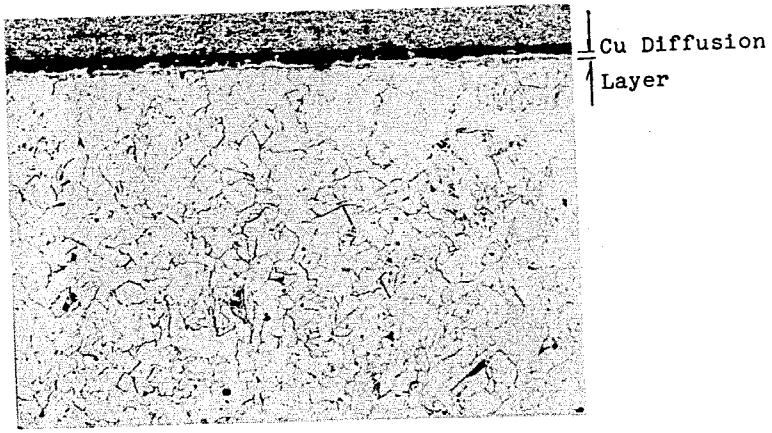

A dispersion containing 10 parts of Cu powder and 1 part of KCl dispersed in 0.1 part of CMC was applied on the precleaned surface of a steel slab at a dry coating weight of 1.5 kg/m$^2$, and over it was applied a coat of $Cr_2O_3$ 10-chamotte 40-water glass 20-Zn 5-$SiO_2$ 60 at a coating weight of 4 kg/m$^2$. The coated steel slab was heated to 1240°C for 3.5 hours in a furnace atmosphere, and was then rolled to produce a hot coil. An electronmicrophotograph of the cross section of the coil is shown in FIG. 11. Variation of the silicon line spectrum with depth was measured by the X-ray microanalyzer, and it was found that a uniformly diffused layer with 15% silicon content was formed at the surface.

EXAMPLE 10

Figure 12:
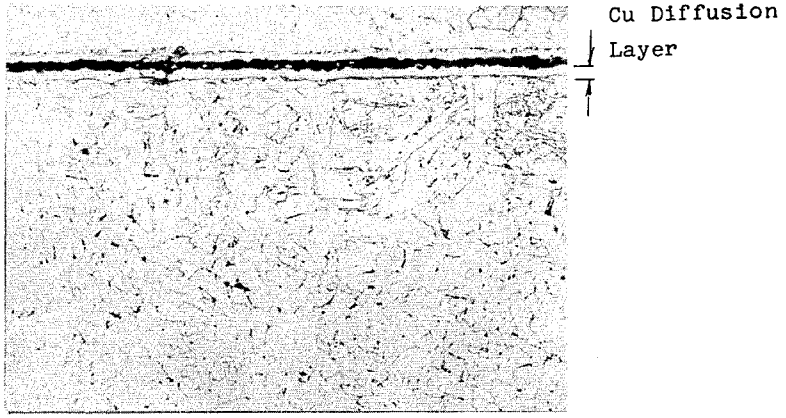
FIGS. 10, 11 and 12 are electromicrographs of the cross sections of steel sheets produced in Examples 7, 8 and 9 according to the invention, respectively.

A dispersion containing 10 parts of Cr powder and 5 parts of $CrCl_3$ dispersed in 1 part of PVA was applied on the precleaned surface of a steel slab at a dry coating weight of 0.5 kg/m$^2$, and over it was applied a coat of $Cr_2O_3$ 10-kaolin 60-water glass 20-Fe 10-$SiO_2$ 60 at a coating weight of 3 kg/m$^2$. The steel slab thus coated was heated to 1200°C for 5 hours in a furnace atmosphere, and was then rolled to produce a hot coil. An electronmicrophotograph of the cross section of the coil is shown in FIG. 12. The X-ray microanalysis showed that a uniformly diffused layer with 30% Cr content was formed at the surface.

EXAMPLE 11

After the surface of a roll for a rolling operation was cleaned by with a sandgrinder, a dispersion containing 10 parts of Cr powder and 3 parts of NaCl dispersed in 0.5 part of a water-soluble resin was applied on the roll surface at a coating weight of 2 kg/m$^2$, and over it was applied a coat of $Cr_2O_3$ 5-kaolin 40-water glass 30-Fe 7-$SiO_2$ 50 at a coating weight of 3 kg/m$^2$. The coated roll was heated in a furnace atmosphere to 100°C for 15 hours. After that, the coating of the treated roll was removed by high pressure water. The X-ray microanalysis showed that a uniformly diffused layer with 24% Cr content was formed at the surface.

CONTROL 4

Figure 13:
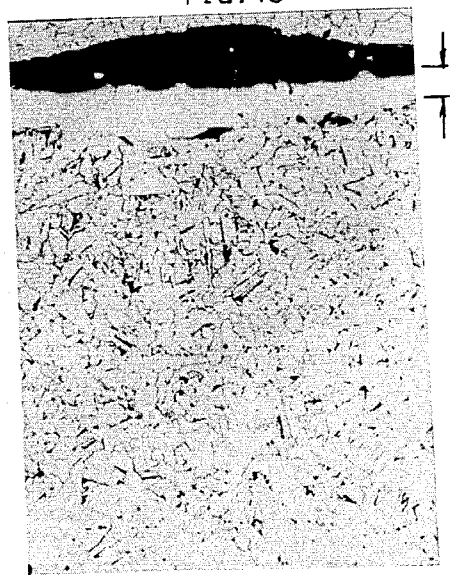
FIGS. 13 and 14 are electronmicrographs of the cross sections of steel sheets produced in Controls 4 and 5, according to prior art, respectively.

A dispersion containing 10 parts of Si powder dispersed in 3 parts of water glass was applied on the precleaned surface of a steel slab at a coating weight of 1.0 kg/m$^2$, and over it was applied a coat of $Cr_2O_3$ 15-kaolin 20-water glass 30-Al 10-$SiO_2$ 60 at a coating weight of 4 kg/m$^2$. The coated slab was heated to 1240°C for 4.5 hours in a furnace atmosphere, and was then rolled to produce a hot coil. An electronmicrophotograph of the cross section of the coil is shown in FIG. 13. The X-ray microanalysis showed that the thickness of the diffused layer was smaller than the above because of exclusion of the chloride from the diffusion coating.

CONTROL 5

Figure 14:
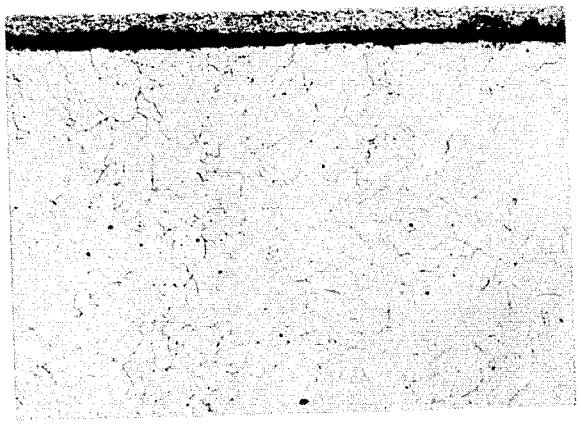

A dispersion containing 10 parts of Cr powder dispersed in 3 parts of water glass was applied on the precleaned surface of a steel slab at a coating weight of 1.0 kg/m$^2$, and over it was applied a commercially available antioxidant at a coating weight of 4 kg/m$^2$. The coated slab was heated to 1250°C for 4 hours in a furnace atmosphere. An electronmicrophotograph of the cross section of the treated steel slab is shown in FIG. 14. No Cr-diffused layer could be detected by the X-ray microanalysis.

EXAMPLE 12

Figure 18:
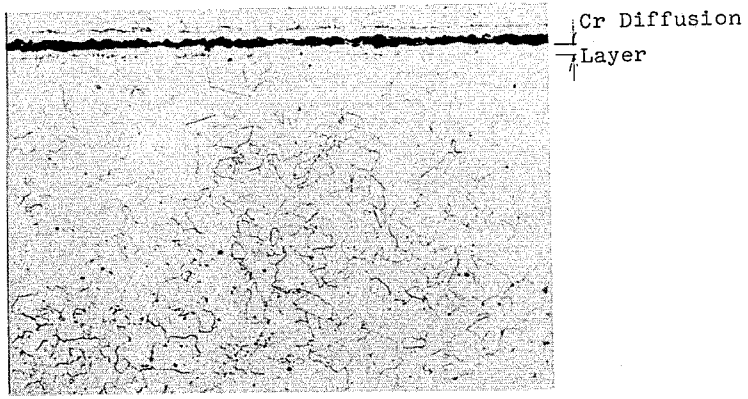

A mixture containing 10 parts of Cr powder and 0.1 part of PVA was applied on the precleaned surface of a steel slab of 180 mm thickness at a coating weight of 0.3 kg/m$^2$, and over it was applied a coat of $Cr_2O_3$ 10-chamotte 20-water glass 30-Al 10-$SiO_2$ 60 in a coating weight of 5 kg/m$^2$. The coated slab was heated to 1280°C for 4 hours and was then rolled to 20 mm thickness. An electronmicrophotograph of the cross section of the steel sheet having a diffused layer of 28 microns thick with 15% Cr content is shown in FIG. 18.

EXAMPLE 13

Figure 19:
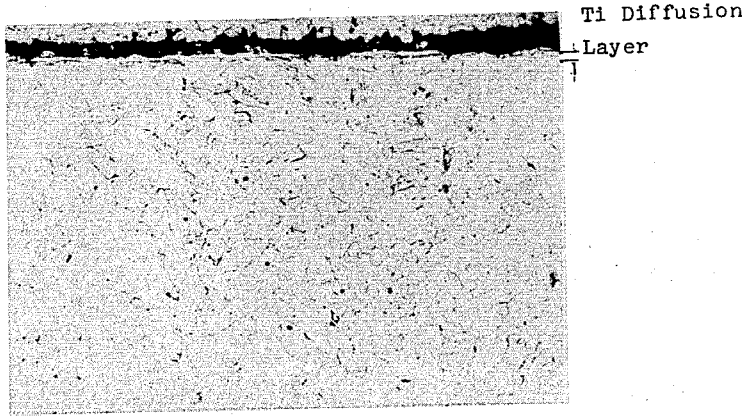

A mixture containing 10 parts of $TiH_4$ powder and 0.1 part of CMC was applied on the precleaned surface of a steel slab of 250 mm thickness in a coating weight of 0.5 kg/m$^2$, and over it was applied a coat of $Cr_2O_3$ 5-chamotte 30-water glass 20Al 3-$SiO_2$ 50 in a coating weight of 4 kg/m$^2$. The coated slab was heated to 1300°C for 3 hours in a furnace atmosphere and was then rolled to 15 mm thickness. An electronmicrophotograph of the cross section of the resultant steel sheet having a diffused layer of 35 microns thick with 23% Ti content is shown in FIG. 19.

EXAMPLE 14

Figure 20:
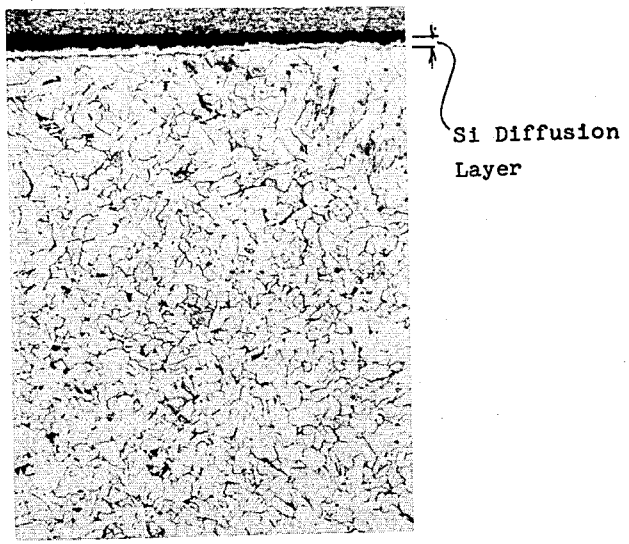

A mixture containing 10 parts of silicon powder and 0.1 part of PVA was applied on the precleaned surface of a slab of 230 mm thickness in a coating weight of 0.7 kg/m$^2$, and over it was applied a coat of $Cr_2O_3$ 10-chamotte 35-water glass 20-Al 5-$SiO_2$ 50 in a coating weight of 3.5 kg/m$^2$. The coated slab was heated to 1220°C for 6 hours in a furnace, and was then rolled to a hot coil of 3.2 mm thick. An electronmicrophotograph of the cross section of the coil having a diffused layer of 20 microns thick with 15% Si content at the surface is shown in FIG. 20.

EXAMPLE 15

Figure 21:
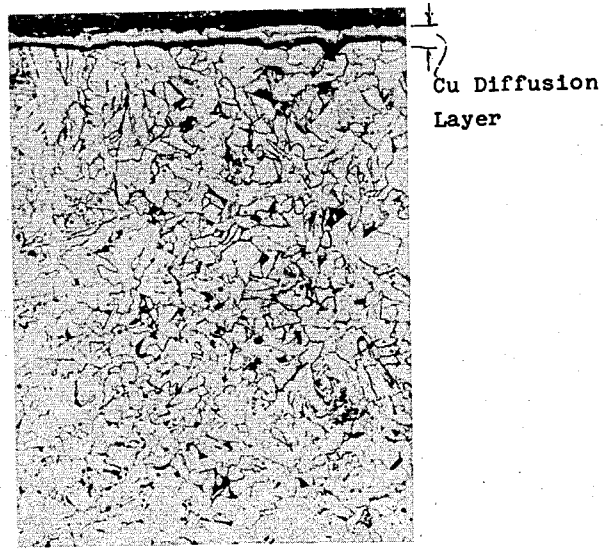

A mixture containing 10 part of Cu powder and 1 part of water glass was applied on the precleaned surface of an H type steel beam blank in a coating weight of 0.4 kg/m$^2$, and over it was applied a coat of $Cr_2O_3$ 5-chamotte 40-water glass 20-Al 5-$SiO_2$ 30 in a coating weight of 4 kg/m$^2$. The coated beam blank was heated to 1270°C for 2.5 hours in a furnace. An electronmicrophotograph of the cross section of the resultant H type steel product having a diffused layer of 60 microns thick with 5% Cu content at the surface is shown in FIG. 21.

EXAMPLE 16

A mixture containing 10 parts of Cr powder dispersed in 3 parts of water glass was applied on the precleaned surface of a roll for rolling operation in a coating weight of 0.1 kg/m$^2$, and over it was applied a coat of $Cr_2O_3$ 10-chamotte 40-water glass 20-Al 5-$SiO_2$ 20 in a coating weight of 4 kg/m$^2$. The coated roll was heated to 1140°C for 8 hours in atmospheric air. Upon separation of the coating, a chromized roll of which the Cr content to depths up to 80 microns was 1.2 times that of the inner portion was obtained.

CONTROL 6

Figure 22:
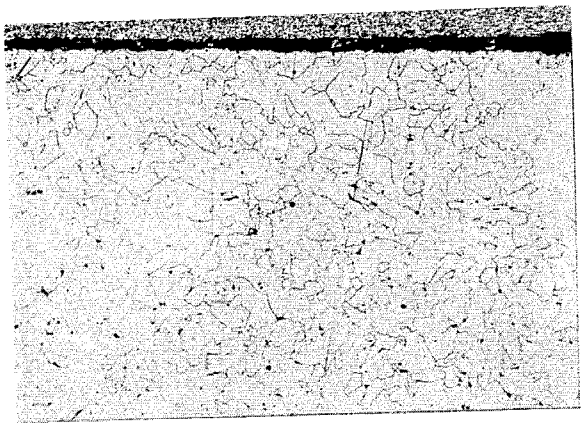
FIGS. 18, 19, 20, 21 and 22 are electronmicrographs of the cross-sections of steel sheets produced in Examples 11, 12, 13 and 14, and Control 6, respectively.

A mixture containing 10 parts of Cr powder and 0.1 part of PVA was applied on the precleaned surface of a steel slab of 180 mm thickness in a coating weight of 0.3 kg/m$^2$, and over it was applied a commercially available atmosphere-excluding material in a coating weight of 4 kg/m$^2$. The coated slab was heated to 1150°C for 4 hours in a furnace. Almost all the applied Cr powder was oxidized and no diffused layer was detected at the surface of the treated slab. (FIG. 22).

EXAMPLE 17

Figure 25:
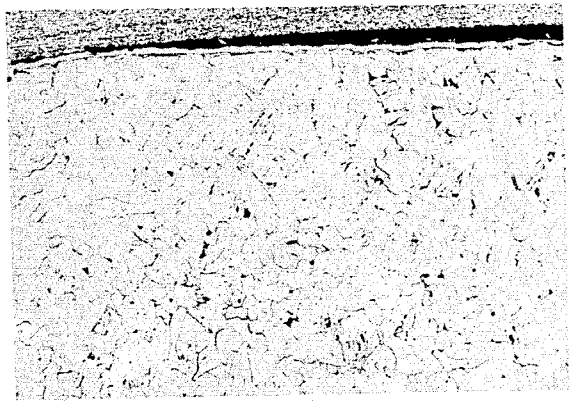
Figure 26:
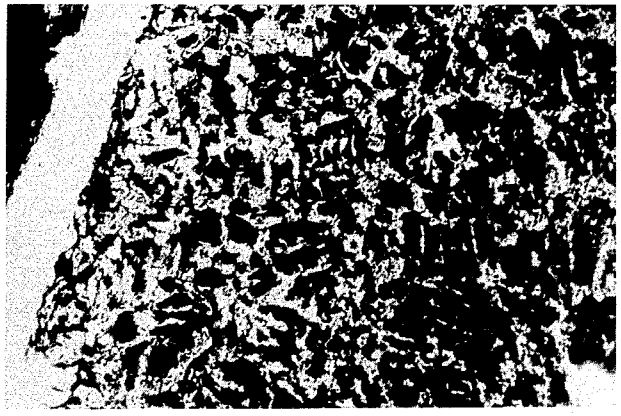

A slurry containing 10 parts of Si powder of reagent grade and 0.1 part of PVA, the remainder being water, was applied on the precleaned surface of a steel slab of 230 mm thick in dry coating weight of 0.7 kg/m$^2$, and over it was applied a coat of $Cr_2O_3$ 10-chamotte 35-water glass 20-A1 5-$SiO_2$ 50 in a coating weight of 3.5 kg/m$^2$. The coated slab was heated to 1220°C for 6 hours in a furnace atmosphere, and was then rolled to 8 mm thickness at a finish-rolling temperature of 890°C. The diffused layer of the hot rolled steel sheet has a thickness of 10 microns, 15% Si content and a porosity of 0.02%. The crystal grain in the base steel was of a uniform size of ASTM Grain No. 8. (FIG. 25).

EXAMPLE 18

After a high carbon steel plate of 30 mm thick was desaled by shotblasting, it was packed in a mixture containing 62 parts of Si powder, 10 parts of ferrosilicon (75% Si) powder, parts of SiC, 10 parts of $CaSiF_6$, 3 parts of $NH_4Cl$ and 5 parts of $SiO_2$ in a closed container, and the container was heated to 1100°C for 3 hours. After that, the steel plate was immediately subjected to a hot-rolling operation to 6 mm thickness at a finish-rolling temperature of 950°C. The resulting steel sheet had a diffused layer of 50 microns thickness with a 13% Si content and a porosity of 0.04%. The size of the crystal grains in the base steel were of a size of ASTM Grain No. 5.

EXAMPLE 19

A slurry containing 10 parts of ferrosilicon (75% Si) powder and 0.1 part of PVA, the remainder being water, was applied on the precleaned surface of a corrosion-resistant Cu-Cr low alloy steel slab of 230 mm thick in a dry coating weight of 1.7 kg/m$^2$, and over it was applied a coat of $Cr_2O_3$ 10-chamotte 20-water glass 30-Al 10-$SiO_2$ 60 in a coating weight of 5 kg/m$^2$. The coated slab was heated to 1280°C for 4 hours in a furnace atmosphere, and was then rolled to an 18 mm thickness at a finish-rolling temperature of 930°C. The resultant steel sheet had a diffusion layer 50 microns thick with a 53% Si content and a porosity of 0.08%. The size of the crystal grains of the base alloy steel were of ASTM Grain No. 7.

EXAMPLE 20

A steel part of 30 mm thickness was descaled and placed in a tubular furnace into which nitrogen gas carrying 10 vol% of silicon tetrachloride heated to 1230°C was allowed to flow at a speed of 100 ml/min. for 3 hours. After that, the silicon tetrachloride was purged, and immediately the steel part was hot rolled to a 5 mm thickness at a finish-rolling temperature of 860°C by using a hot roll test machine. The resultant steel sheet had a diffused layer of 150 microns thick with and 18% Si content and a porosity of 0.09%. The size of the crystal grains in the base steel were ASTM Grain No. 7.

CONTROL 7

A steel part of 30 mm thickness was descaled and packed in a mixture containing 62 parts of Si powder, 10 parts of ferrosilicon (75% Si) powder, 10 parts of SiC, 10 parts of $CaSiF_6$, 3 parts of $NH_4Cl$ and 5 parts of $SiO_2$ in a closed container. The container was heated to 1100°C for 3 hours. After that, the steel part was taken from the container and was immediately cooled. The silicon-diffused layer had a porosity of 25%, and the size of the crystal grains in the base steel was of ASTM Grain No. 3.

As will be seen from the foregoing examples, according to the present invention, by utilizing the conventional hot-rolling operation of steel, corrosion-resistant siliconized steel having a non-porous diffused layer at the surface can be produced with ease at low cost.

EXAMPLE 21

A slurry containing 10 parts of a dehydrogenated electrolytic iron powder and 0.1 part of PVA, the remainder being water, was applied on the precleaned surface of an 80 kg/mm$^2$ steel slab having a 210 mm thick in a dry coating weight of 1 kg/m$^2$, and over it was applied a coat of $Cr_2O_3$ 10-chamotte 35-water glass 20-Al 5-$SiO_2$ 50 in a coating weight of 3.5 kg/m$^2$. The coated slab was heated to 1250°C for 4 hours, and was then subjected to a rolling treatment to a 25 mm thickness followed by quenching and tempering treatments. The resultant steel sheet had a diffused layer 15 microns thick with 99.2% Fe content at the surface. According to the above mentioned stress-corrosion cracking resistance test, a small crack occurred in 25 days.

EXAMPLE 22

A slurry containing 10 parts of a reagent grade pure iron powder, 1 part of $NH_4Cl$ and 0.1 part of a water-soluble acrylic resin, the remainder being water, was applied on the precleaned surface of a 80 kg/mm$^2$ steel slab of 230 mm thickness in a dry coating weight of 1.3 kg/m$^2$, and over it was applied a coat of $Cr_2O_3$ 10-chamotte 20-water glass 30-Al 10-$SiO_2$ 60 in a coating weight of 5 kg/m$_2$. The coated slab was heated to 1280°C for 6 hours, and was then subjected to a rolling treatment to a 25 mm thickness followed by quenching and tempering treatments. The steel sheet had a diffused layer 60 microns thick with a 99.6% Fe content at the surface. According to the cracking test, no crack occurred in 30 days.

EXAMPLE 23

A steel sheet having the chemical composition and mechanical properties shown in Tables 4 and 5 was plated in a solution containing 278 g/l of $FeSO_4.7H_2O$ and having pH values of 2.65–2.95 at a temperature of 75°C±1°C with a current density of 10 A/dm² to form a surface layer 50 microns thick with a 99.8% Fe content on the surface of the steel sheet. The plated sheet was subjected to dehydrogenation at 600°C for 2 hours and in the cracking test, no cracks occurred in 30 days.

CONTROL 8

A steel sheet of the specification shown in Tables 4 and 5 was subjected to a decarburization treatment with hydrogen to produce a sheet having a surface layer of 0.2 mm thick with a 0.04% C content. Cracking was caused in 5 days by the cracking test.

As will be seen from the foregoing examples, according to the present invention, increased stress corrosion cracking resistance and other improved retarded rupture resisting properties can be imparted to high tension steel and stainless steel.

EXAMPLE 24

For the diffusion treatment of a steel slab having the following composition in an ordinary oxidizing atmosphere, the surface of the steel slab was coated with powders of a metal or alloy (in the case when two or more kinds of metals or alloys are used, mixed powders are used) or powders of a ferro alloy together with a binding agent, and was then coated with the same oxidation preventing composition as in Example 1.

C : 0.13–0.17%
Si : 0.008–0.012%
Mn : 0.55–0.68%
P : 0.010–0.019%
S : 0.010–0.023%

By the above treatment various diffused layers were obtained as shown in Table 6. The steels having such diffused layers showed excellent corrosion resistance against sea water.

It has been found that excellent corrosion resistance against sea water can be obtained when the diffused layer of at least 10μ depth contains 15–80% of Cr and one or more of Al, Ti, Ni and Mo in an amount of 2 to 20%.

Table 6

| Sample | Depth(μ) | Diffused Layer (%) Composition(%) | | | | | Corrosion Amounts |
|---|---|---|---|---|---|---|---|
| | | Cr | Al | Ti | Ni | Mo | (μ)* |
| 1 | 37 | 48.1 | 13.2 | | | | 12 |
| 2 | 30 | 45.5 | | 18.9 | | | 21 |
| 3 | 40 | 40.3 | | | 6.1 | | 8 |
| 4 | 33 | 43.7 | 8.3 | 6.5 | | | 13 |
| 5 | 33 | 47.2 | 3.1 | | 3.6 | | 9 |
| 6 | 35 | 46.8 | 6.6 | | | 2.5 | 11 |
| 7 | 31 | 46.7 | | 10.5 | 0.5 | | 17 |
| 8 | 38 | 44.5 | | 2.5 | | 1.3 | 21 |
| 9 | 32 | 40.7 | | | 1.6 | 1.3 | 12 |
| 10 | 96 | 42.9 | 7.5 | 6.1 | 5.6 | | 11 |
| 11 | 91 | 42.3 | | 2.3 | 15.8 | 0.9 | 9 |
| 12 | 87 | 41.1 | 1.3 | | 4.1 | 8.5 | 9 |
| 13 | 85 | 49.3 | 8.7 | 1.5 | | 3.5 | 12 |
| 14 | 35 | 48.8 | 1.7 | 1.6 | 4.7 | 3.1 | 9 |
| 15 | 13.6 | 25.1 | 18.5 | | | | 12 |
| 16 | 29.4 | 28.5 | 16.9 | | | | 12 |
| 17 | 55.9 | 26.4 | 16.6 | | | | 12 |

*Corrosion amounts were determined from the results of a six months test in which the specimens were immersed in sea water with rotation and dried in a repeated manner.

EXAMPLE 25

This example shows the production of a steel material having excellent pit corrosion resistance by introducing titanium into a chromizing layer to lower the carbon activity in the base steel, thereby to prevent the appearance of a segregated phase of TiC in the diffused layer.

A mixture of metal powders to be diffused is applied on the steel materials as shown in Table 7 together with a binding agent, and the same oxidation preventing agent as in Example 1 was applied thereon. The thus coated steels were heated in an oxidizing atmosphere to form a complex diffusion layer of Cr and Ti as shown in Table 7.

The steels having a complex diffusion layer as shown in the table showed excellent pit corrosion resistance. It has been found that excellent pit corrosion resistance can be obtained when the Cr-Ti diffusion layer of at least 10μ thickness contains 0.5–20% of Ti, and it is desirable that the steel substrate contains 0.01 to 0.25% of carbon and at least one element which lowers the carbon activity in an amount of 4 to 5 times of the carbon content.

Table 7

| Sample | Base Steel Composition | | | Complex Diffusion Layer | | | Corrosion* Amounts(μ) | |
|---|---|---|---|---|---|---|---|---|
| | C(%) | Ti or Nb or Zr(%) | Ti+Nb+Zr/C | Depth (μ) | Composition(%) Cr | Ti | Average Corrosion Amount | Maximum Pit Corrosion Depth** |
| 1 | 0.005 | No Addition | — | 35 | 27.1 | 0.5 | 20 | 22 |
| 2 | 0.004 | " | — | 48 | 25.0 | 7.1 | 15 | 18 |
| 3 | 0.008 | " | — | 44 | 31.1 | 15.8 | 11 | 15 |
| 4 | 0.13 | Ti 0.53 | 4.2 | 37 | 26.2 | 5.8 | 17 | 22 |
| 5 | 0.18 | Nb 2.21 | 12.3 | 37 | 25.8 | 6.1 | 17 | 23 |
| 6 | 0.12 | Nb 1.07 | 8.9 | 34 | 28.5 | 6.7 | 16 | 22 |
| 7 | 0.12 | Zr 1.02 | 8.5 | 41 | 27.0 | 15.9 | 12 | 15 |

*Corrosion amounts were determined from the results of six months test in which the specimens were immersed in the sea water with rotation and dried in a repeated manner.
**Maximum pit corrosion depth is the depth from the original steel surface of deepest pit.

What is claimed is:

1. In a process for treating a steel surface with a coating to protect the surface during heating in an oxidizing atmosphere, the improvement which comprises coating the surface with a first base coating comprising a compound capable upon heating of producing a gas selected from the group consisting of carbon dioxide, carbon monoxide, nitrogen, hydrogen chloride, chlorine and hydrogen, coating said first coating with a second coating of an atmospheric shielding agent composition comprising $CrO_3$, a refractory or clay, $SiO_2$, a reducing agent, and water glass, and then subjecting the coated steel surface to the heat and oxidizing treatment.

2. The process according to claim 1, in which the atmosphere shielding composition comprises;

1. 1–20 parts by weight of $Cr_2O_3$;
2. 1–20 parts by weight of one or more reducing agents selected from the group consisting of Al, Zn, Cu, Ni, Co, Mn, Mg, Fe, Cr, Ti, Zr, Sr, Mo, Sn, In, C, $Fe_2O_3$ and FeO;
3. 5–80 parts by weight of one or more clays or refractories selected from the group consisting of silica powder, kaolin, magnesia powder, montmorillonite, $MgO\text{-}Cr_2O_3$ refractories, $MgO\text{-}SiO_2$ refractories and doromite refractories;
4. 5–120 parts by weight of silicic acid anhydride; and
5. 5–120 parts by weight of water glass.

3. The process according to claim 1, wherein the base coating further comprises a diffusing agent selected from the group consisting of Mg, Al, Si, Cu, Se, Ti, V, Cr, Mn, Fe, Co, Ni, Ca, Zn, Ga, Ge, As, Sr, Zr, Nb, Mo, Ag, Cd, Sn and Ba.

4. The process according to claim 1, in which the base coating comprises a chloride which generates chlorine or hydrogen chloride gas upon heating.

5. The process according to claim 4, in which the chloride is at least one selected from the group consisting of $NH_4Cl$, KCl and NaCl.

* * * * *

UNITED STATES PATENT OFFICE

CERTIFICATE OF CORRECTION

Patent No. 3,950,575 Dated April 13, 1976

Inventor(s) Minoru Kitayama et al

It is certified that error appears in the above-identified patent and that said Letters Patent are hereby corrected as shown below:

In the heading of the Patent [30] should read as follows:

--[30]Foreign Application Priority Data

Jan. 23, 1973.....Japan.....48-9206
May 21, 1973.....Japan.....48-56533
May 21, 1973.....Japan.....48-56534
May 21, 1973.....Japan.....48-56535
June 19, 1973.....Japan.....48-68988
Sept. 6, 1973.....Japan.....48-100553--.

Signed and Sealed this

*twenty-ninth* Day of *June 1976*

[SEAL]

*Attest:*

RUTH C. MASON
*Attesting Officer*

C. MARSHALL DANN
*Commissioner of Patents and Trademarks*